United States Patent [19]

Tanigawa et al.

[11] Patent Number: 4,506,041

[45] Date of Patent: Mar. 19, 1985

[54] POWDERED BINDER FOR MOLD-MAKING AND A PROCESS FOR PREPARING A MOLD BY USING THE SAME

[75] Inventors: Takatoshi Tanigawa, Tokyo; Sakari Yaegashi, Ichikawa; Tetsuo Nakazawa, Ibaraki; Masahiko Hatazi, Suzuka; Tadao Nango, Tokyo, all of Japan

[73] Assignees: Hitachi, Ltd.; Kinsei Kogyo Co., Ltd., both of Tokyo, Japan

[21] Appl. No.: 509,394

[22] Filed: Jun. 30, 1983

[30] Foreign Application Priority Data

Jul. 5, 1982 [JP] Japan ..... 57-116454
Aug. 20, 1982 [JP] Japan ..... 57-143339

[51] Int. Cl.[3] ..... B22C 1/00; B22C 3/00

[52] U.S. Cl. ..... 523/139; 524/556; 524/559; 525/327.8

[58] Field of Search ..... 525/327.8; 523/139; 524/559, 556

[56] References Cited

U.S. PATENT DOCUMENTS

| | | | |
|---|---|---|---|
| 3,073,805 | 1/1963 | Reinhard | 525/327.8 |
| 3,178,389 | 4/1965 | Hallenbeck | 524/382 |
| 3,267,083 | 8/1966 | Imhof | 525/327.8 |
| 3,625,854 | 12/1971 | Gower et al. | 252/171 |
| 3,682,868 | 8/1972 | Wollner et al. | 525/327.8 |
| 4,071,669 | 1/1978 | Tazuma et al. | 525/327.8 |
| 4,223,109 | 9/1980 | Wolgemuth | 525/327.8 |
| 4,269,256 | 5/1981 | Nakazawa et al. | 524/556 |
| 4,330,459 | 5/1982 | Takahashi et al. | 524/603 |

FOREIGN PATENT DOCUMENTS

| | | | |
|---|---|---|---|
| 890489 | 1/1972 | Canada | 525/327.8 |
| 0079672 | 5/1983 | European Pat. Off. . | |
| 1069637 | 5/1967 | United Kingdom | 525/327.8 |
| 1245011 | 9/1971 | United Kingdom | 525/327.8 |
| 2040976 | 9/1980 | United Kingdom . | |

OTHER PUBLICATIONS

Derwent Abst. 78010 Y/44, (10–1975), J50126039.
Derwent Abst. 05216 J/49, (10–1982), J57174364.
Derwent Abst. 08992 A/05, (12–1977), J52150421.

*Primary Examiner*—Herbert J. Lilling
*Attorney, Agent, or Firm*—Antonelli, Terry & Wands

[57] ABSTRACT

A binder of this invention is a powder which comprises an intimate mixture of a copolymer of maleic anhydride with an olefinically unsaturated compound selected from the group consisting of an aliphatic α-olefin having 2 to 8 carbon atoms, styrene and methyl vinyl ether, 0.2 to 2.0 equivalents of a caustic alkali per carboxyl equivalent of said copolymer, and if desired, 30 to 500 parts by weight of an alkaline earth metal hydroxide per 100 parts of the total weight of said copolymer and said caustic alkali, and if desired, up to 300 parts by weight of additive per 100 parts of the total weight of said copolymer and said caustic alkali. A process for preparing a mold according to this invention comprises mixing said powdered binder with refractory particles and a small amount of water under agitation, and forming the resulting mixture into a shaped product, whereafter the shaped product is hardened by blowing $CO_2$ gas therethrough.

17 Claims, No Drawings

POWDERED BINDER FOR MOLD-MAKING AND A PROCESS FOR PREPARING A MOLD BY USING THE SAME

BACKGROUND OF THE INVENTION

1. Field of the Invention

This invention relates to a powdered binder for binding refractory particles such as sand used for making a mold and a process for preparing a mold by using such a binder.

2. Description of the Prior Art

In practical molds for casting metals, there have been used inorganic binder materials such as sodium silicate and organic ones such as phenol resins, furan resins, etc. All the molds prepared by using these binder materials are durable to pressure or heat exerted by a molten metal. However, a mold containing an inorganic binder has such drawbacks that it is very difficult to remove castings therefrom and it requires a lot of man-hours to produce the castings after pouring, because the mold is very difficult to disintegrate. A mold prepared from an organic binder does not cause such problems, but injurious gases are generated when a molten metal is poured thereinto.

In order to harden a mold, both a hardening process using a chemical reaction of binder components incorporated into molding sand, and a process wherein a mold is hardened by blowing $CO_2$ gas or an amine gas into the mold after a pattern is filled with molding sand containing a binder may be employed. In the case of the former, a period of time during which the molding sand can be effectively used, i.e., a bench life is limited, because the chemical reaction takes place simultaneously with the addition of a binder to the molding sand. The latter is further classified into a so-called $CO_2$ process wherein the hardening is effected by blowing $CO_2$ gas into molding sand containing a binder such as sodium silicate, a process wherein the hardening is effected by blowing an amine gas into molding sand containing a hydroxyl group-containing resin (e.g. phenol resin) and a polyisocyanate as binder, and a process wherein a combination of an acrylic copolymer or a phenol resin and calcium hydroxide is hardened by $CO_2$ gas. The mold production efficiency of these processes is satisfactory, because the bench life of molding sand is longer than that utilizing a chemical reaction of binder components contained in molding sand, and a mold is rapidly hardened as a gas is introduced. However, the conventional $CO_2$ process has a defect that a mold is difficult to disintegrate, because sodium silicate is used as a binder. Also, the process using an amine gas suffers from the toxicity and unpleasant odor of such gas. Further, the process wherein a mold comprising a copolymer of an acrylate ester, ammonium acrylate and sodium acrylate and calcium hydroxide is hardened by blowing $CO_2$ gas thereinto has a drawback that not only the working environment is polluted by ammonia gas generated during the preparation of molding sand or the formation of a mold, but also the strength of the mold immediately after $CO_2$ blowing is unsatisfactory. Moreover, the process using a phenol resin provides a mold whose strength is lowered, because the mold is hardened only by natural drying.

As disclosed in our U.S. Pat. No. 4,269,256, we already proposed, as a technique for solving the aforesaid problems associated with the $CO_2$ process and the other prior art processes for producing a mold, a method for preparing a mold which comprises mixing refractory particles with a binder material comprising a combination of an alkali-neutralized product of at least one copolymer selected from α-olefin-maleic anhydride copolymers, styrene-maleic anhydride copolymers and methyl vinyl ether-maleic anhydride copolymers with at least one of polyvalent metal hydroxides and oxides, and then hardening the mixture by $CO_2$ gas.

According to the present invention, it has become possible that while retaining the advantages of the above-described process, the problems associated therewith are alleviated, resulting in that the method can be widely used, the molds prepared thereby are more easily tractable, and economical loss is minimized.

The above-described prior art included the following problem. That is, the operation of preparing a solution of an alkali-neutralized product of a copolymer to be used was not simple, and an alkali-neutralized product, i.e., a liquid binder dissolved in an alkali solution was used in order to maintain the binding efficiency of a copolymer.

Thus, it has been found difficult to choose a binder material having the binding property suitable for the properties of a material to be bound or the purpose of using a bound product, as the concentration of a polymer in solution is fixed.

A polymer solution is generally prepared to have concentration which is most frequently needed. However, a solution of a fixed concentration is inconvenient, when finer adjustment of the concentration is required for the purpose of using it in such case that it is necessary to increase the amount of a polymer without changing the amount of water. For such purpose, it is required to provide many solutions having different polymer concentrations. However, it is substantially disadvantageous and not practicable to provide many solutions of different polymer concentrations.

When a polymer is used as a solution, it is difficult and sometimes practically impossible to disperse a small amount of a solution of a high concentration throughout particles having a high surface area.

Though it may be considered to be a simple operation to change a polymer into a solution, it actually takes a long time, and the preparation of a solution having a desired concentration for each case is disadvantageous. Thus, there is a drawback that the extent of application is limited in the use of a polymer solution having a fixed concentration as a binder for particles.

Next, a polymer solution is not easily tractable. Such solution has generally a high viscosity, and in particular, its viscosity further increases when powders such as an alkaline earth metal hydroxide and the like are suspended therein. Accordingly, the amount of the solution sticked to a container, a metering unit and the adjuvant devices therefor is large and causes a significant economical loss. Further, precise metering cannot be expected in the case of a simple procedure. Further, a polymer solution comprises at least 50% of water. A loss caused by dealing with the everywhere-available water during the storage and transfer of containers, and the like is not a little.

Further, when an alkaline earth metal hydroxide powder such as calcium hydroxide is suspended in a polymer solution for the purpose of convenience, calcium hydroxide is precipitated at a certain concentration of the polymer practically applicable in a wide extent of use. Accordingly, continuous agitation is required in order to use the mixture at a correct ratio of the components. This is a troublesome operation. In order to avoid such problem, a suitable amount of a styrene-butadiene rubber latex may be added to prevent the precipitation of calcium hydroxide. This styrene-butadiene rubber latex can be also used in the present invention as an adjuvant to increase the strength of binding. However, though a styrene-butadiene rubber latex increases the strength of binding and prevents the precipitation of calcium hydroxide, it produces unpleasant odor upon heating and pollutes the working environment. Water-soluble powders of a polymer not in the state of a solution are now commercially available, but they can be scarcely used, because they are ammonia-neutralized products and significantly pollute the environment by generating ammonia gas upon the incorporation of calcium hydroxide and heating. Further, the generation of ammonia gas causes a blowhole in castings, when the casting mold contains a certain kind of binder material. Thus, it is often avoided to use a material capable of generating ammonia gas.

SUMMARY OF THE INVENTION

It is an object of this invention to provide a binder that may be easily blended with molding sand.

It is another object of this invention to provide a binder that generates almost no injurious gas upon the pouring of a molten metal.

It is a further object of this invention to provide a process for preparing a mold that has an increased strength when a molten metal is poured thereinto, and can be relatively easily disintegrated when a cast product is withdrawn therefrom.

It is a still further object of this invention to provide a process for preparing a mold in which a period of time required for hardening molding sand after the incorporation of a binder into the molding sand can be relatively easily selected.

The other objects of this invention and the effects attained thereby will be apparent from the following description.

According to this invention there is provided a powdered binder which comprises an intimate mixture of a copolymer of maleic anhydride and an α-olefinically unsaturated compound selected from the group consisting of an aliphatic $C_{2-8}$ α-olefin, styrene and methyl vinyl ether, 0.2–2.0 equivalents of a caustic alkali per carboxyl equivalent of said copolymer, and 30–500 parts of an alkaline earth metal hydroxide per 100 parts of the total weight of said copolymer and said caustic alkali, and optionally, up to 300 parts by weight of an additive per 100 parts of the total weight of said copolymer and said caustic alkali.

This invention also provides a process for preparing a mold which comprises mixing the above-mentioned binder with particles to be bound and a small amount of water with agitation, forming the resulting mixture into a mold, and hardening the mold by blowing $CO_2$ gas therethrough.

According to this invention, the concentration of a copolymer can be varied in each case. Of course, the amount of a copolymer solution is also freely selectable.

Further, according to this invention, it is possible to uniformly blend a copolymer and a material to be bound by agitating for a practically short time even at a high concentration of the copolymer. This was not achieved in the case of the prior art copolymer solution.

It has been also found that a bound product (mold) having a great thickness can be advantageously hardened to its inside, because the amount of water contained in the mold can be lowered.

Moreover, as a binder material according to this invention is in the state of powder, no precipitation occurs when an alkaline earth metal hydroxide which is a solid powder is added thereto.

Accordingly, a device for preventing precipitation is not necessary. Further, according to this invention, the storage and transfer of containers and the metering and other treatment of the products are easy, and a loss can be decreased.

DETAILED DESCRIPTION OF THE INVENTION

A powdered binder used in the method of this invention for preparing a mold can be conveniently produced by milling a powder of the above-described copolymer of maleic anhydride and a caustic alkali powder, preferably together with an alkaline earth metal hydroxide powder, and if desired, further together with an additive powder at a specified blending ratio. In the above-described case, some adherent water or hygroscopic water is present in the powders of a copolymer, a caustic alkali and other materials. Accordingly, it is considered that a substantially solid reaction, i.e., neutralization in the presence of a much less amount of water than the case of usual neutralization partially takes place. This reaction is not completed, and both an unreacted copolymer phase and an unreacted caustic alkali phase are remaining in the resulting binder powders. The loss of water by heating the binder powders thus obtained up to 100° C. was less than 5% determined by differential thermal analysis.

Alternatively, the specified power components may be mixed and agitated together with a small amount of water. The resulting mud-like product is dehydrated and solidified by the reaction heat, or can be further subjected to drying, if necessary. The dried product thus obtained may be ground to produce a powdered binder. Of course, a similar powder binder can be prepared by using a part or whole of powders of a caustic alkali and water in the form of an aqueous solution of the caustic alkali, or using a part or whole of powders of an alkaline earth metal hydroxide and water in the form of an aqueous solution of the alkaline earth metal hydroxide. The amount of water used is preferably no more than that required by the system to achieve self-dehydration and self-solidification after the components are mixed and agitated, because the end product must be powder. The loss of water determined by differential thermal analysis when a powdered binder produced in this manner was heated up to 100° C. is less than 10%. The amount of water contained in a product prepared by any of the above-described methods may sometimes exceed 10% after prolonged storage, because powdered binders are somewhat hygroscopic. However, binder materials are not essentially deteriorated by such hygroscopic moisture. In either of the above-described methods, the temperature of a system is elevated to 100°–120° C. during the production of binders by a heat of neutralization, a heat of dissolution of a caustic alkali, and the like.

It has been also found that as compared with the prior art operation of dissolving a copolymer in a caustic alkali solution by adding the copolymer with stirring in a small amount at a time, a method of preparing a solution of a neutralized-product of a copolymer at a desired concentration by adding water to an exothermic mixture with stirring as described above is much more efficient and does not incur a risk such as sudden boiling, etc.

A copolymer according to this invention which comprises maleic anhydride and an α-olefinically unsaturated compound selected from the group consisting of an aliphatic $C_2$–$C_8$ α-olefin, styrene and methyl vinyl ether may contain up to 15 mol % of other copolymerizable component. For example, a terpolymer of up to 15 mol % of a maleic acid mono- or diester with the above-described olefinically unsaturated compound and maleic anhydride, and a higher multi-component copolymer can be also used in the practice of this invention.

The molecular weight of a copolymer is not critical and may be satisfactory so long as a desired binding strength is obtained. In the prior art disclosed in U.S. Pat. No. 4,269,256, a copolymer having a molecular weight of $15\times10^4$ or more brings about a copolymer solution remarkably more viscous than that obtained from a copolymer having a molecular weight of $6.5\times10^4$ or less at the same level of concentration and the same degree of neutralization, and cannot be thoroughly dispersed in particles to be bound. Thus, the concentration of a copolymer used in a solution was limited.

According to this invention it has been found that a copolymer having a molecular weight of $15\times10^4$ or more can be used without any restriction. However, a copolymer having a molecular weight of $17\times10^4$ or less can be preferably used.

As a main component of a binder material, a resol type phenol resin may be also used together with the above-described maleic anhydride copolymer.

Examples of a caustic alkali component are NaOH, KOH and LiOH. Among them NaOH and KOH are preferable.

A caustic alkali is used in an amount of 0.2–2.0 equivalents per carboxyl equivalent of a copolymer of maleic anhydride. If the amount of a caustic alkali is substantially lower than 0.2 equivalent per carboxyl equivalent of a copolymer of maleic anhydride, the viscosity of a polymer solution is lowered and the binding efficiency thereof is disadvantageously reduced. The upper limit of the amount of a caustic alkali to be used is not critical. However, the presence of a strong alkali in excess is disadvantageous, because the binding efficiency of a binder decreases and other deleterious effects may be encountered.

When NaOH is used, about 10–100 parts by weight of NaOH are preferably used per 100 parts by weight of a copolymer of maleic anhydride, depending upon the nature of the latter.

In order to increase the binding efficiency of a powder binder of this invention and impart thereto a property of hardening in the presence of $CO_2$ gas, an alkaline earth metal hydroxide may be preferably incorporated into, or used together with, the aforesaid powder binder. Suitable alkaline earth metal hydroxides are $Ca(OH)_2$, $Mg(OH)_2$ and $Ba(OH)_2$, with $Ca(OH)_2$ being most preferable and beneficial from the viewpoint of performance and cost. In order to ensure the beneficial property of a binder to be rapidly hardened by $CO_2$ gas, addition of at least 30 parts by weight of an alkaline earth metal hydroxide per 100 parts of the total weight of a copolymer and a caustic alkali is necessary.

The upper limit of the amount of an alkaline earth metal hydroxide is not critical. However, addition of an alkaline earth metal hydroxide in an amount exceeding 5 times the total weight of a copolymer and a caustic alkali is unprofitable. The best result can be obtained by using an alkaline earth metal hydroxide in an amount of 80–200 parts by weight per 100 parts of the total weight of a copolymer and a caustic alkali.

If desired, an additive may be incorporated into, or used together with, a powdered binder of this invention. Suitable fillers are oxides of Fe, Al and Si, bentonite, talc and satin white. The amount of a filler is preferably up to 300 parts by weight, particularly up to 150 parts by weight, per 100 parts of the total weight of a copolymer and a caustic alkali.

The binder powders used in this invention should have a fine particle size from the viewpoint of workability and binding efficiency. However, those powders at least 95% of which pass through a JIS (or A.S.T.M.) standard sieve of 149μ may be beneficially used in a practical blending time. Powders having a somewhat more rough particle size distribution may be also used, if a longer blending time is employed. Accordingly, it is not advantageous from the viewpoint of cost and tractability to grind the powders into an extremely fine particle size.

A process for preparing a mold according to this invention comprises mixing refractory particles with an intimately blended powder mixture of a copolymer described above and a caustic alkali, powders of an alkaline earth metal hydroxide and water with agitation, or alternatively, mixing refractory particles with an intimately blended powder mixture of a copolymer, a caustic alkali and an alkaline earth metal hydroxide and water with agitation, then forming the molding composition thus obtained into a mold, and hardening the mold by blowing $CO_2$ gas therethrough.

The components may be blended in the manner that binder powders are present in such amount that the total weight of a copolymer and a caustic alkali represents 0.4–10 parts, preferably 0.6–5 parts per 100 parts by weight of refractory particles, and the amount of water represents 1–10, preferably 2–5 parts by weight per 100 parts by weight of refractory particles.

In whichever manner an alkaline earth metal hydroxide is either incorporated as a previously intimately blended mixture with a copolymer and a caustic alkali, or incorporated separately from an intimate mixture of a copolymer and a caustic alkali, the amount of the alkaline earth metal hydroxide is 30–500 parts, preferably 80–200 parts by weight per 100 parts of the total weight of the copolymer component and the caustic alkali component. An alkaline earth metal hydroxide may be added as a solution or suspension in the water to be added.

In the preparation of a composition for forming a mold, binder powders can be first added to refractory particles and then a liquid component can be added to the resulting mixture, or alternatively, a liquid component can be first added to refractory particles and then binder powders can be added to the resulting mixture. However, a procedure which comprises previously mixing binder powders and a liquid component, and then adding refractory particles to the resulting mixture deteriolates the dispersibility of powders and will give a poor result as compared with those described above.

If desired, additive can be added when a composition for forming a mold is prepared. Suitable additives are wooden powder, coal powder and petroleum pitch which are used for the purpose of improving the surface property of a cast product; a monohydric alcohol such as methanol and ethanol, a polyhydric alcohol such as ethylene glycol, glycerol and sorbitol, and aceton which are used for the purpose of increasing the initial binding strength of a mold; and a water-soluble high molecular compound such as polyvinyl alcohol and sodium polyacrylate, a resol or novalak type phenol resin and a styrene-butadiene rubber latex which are used for the purpose of increasing the ultimate binding strength of a mold.

A molding composition containing well-mixed refractory particles and a binder can be obtained by agitating and mixing for a time of generally up to 5 minutes, particulary 2–3 minutes, depending upon the performance of a mixer employed and the amount of materials to be mixed. The bench life of a composition prepared in such manner may be as long as 24 hours, if the drying is prevented by using a simple cover over the composition and water is not allowed to evaporate for 5–6 hours.

A molding composition can be formed into a mold and hardened in the same manner as the conventional process of using a liquid binder.

A molding composition is filled into a suitable wood pattern and hardened by blowing $CO_2$ gas thereinto. A desired mold can be prepared by withdrawing the hardened product from the wooden pattern after a predetermined level of strength is reached, and allowing the resulting product to stand in the air or forcedly drying it. In this connection, a mold can be also obtained by allowing it to stand in the air or forcedly drying it without blowing any $CO_2$ gas.

A mold according to this invention is scarcely adhesive to a wooden pattern, and as a result, any parting material is not required. Further, it has been found that a uniform hardening step can be efficiently proceeded by lowering the amount of water to be employed as low as possible, when a mold having a great thickness is desired.

A process for preparing a mold according to this invention attains the following effects: (1) The preparation of molding sand is easy; (2) A binder material can be easily removed by washing with water, even if it adheres to a body or clothes; (3) Molding sand has a long bench life; (4) A mold has a high strength; (5) The working environment is kept well when a mold is formed; (6) A mold can be efficiently produced; (7) A mold can obtain a desired strength, even if a small amount of $CO_2$ gas is used; (8) A mold after blowing $CO_2$ gas is self-hardenable; in addition; (9) The concentration of a binder and the amount thereof to be used can be widely selectable depending upon the properties of refractory particles employed and the end use of a mold; and (10) Manufacturing cost can be reduced by lowering operational and economical losses.

A powder binder of this invention which is very useful for preparing a mold is also suitable for bonding aggregates such as sand as a wall material and can be suitably used for adhering plywood and other wooden materials after the binder has been dissolved in water.

DESCRIPTION OF THE PREFERRED EMBODIMENTS

This invention will be further explained by the following examples.

EXAMPLE 1

Mixed powder A

A powder obtained by milling a mixture in a porcelain ball mill for 10 minutes, said mixture comprising powders of an isobutylene-maleic anhydride copolymer (MW $5.5\times10^4$–$6.5\times10^4$) having a particle size such that 100% pass through a JIS (or A.S.T.M.) standard sieve of 74μ (200 mesh) and powders of NaOH in the weight ratio of 80:40.

Mixed powder B

A powder obtained by milling a mixture in a porcelain ball mill for 10 minutes, said mixture comprising powders of an isobutylene-maleic anhydride copolymer (MW $16\times10^4$–$17\times10^4$) having a particle size such that 100% pass through a JIS standard sieve of 74μ and powders of NaOH in the weight ratio of 80:40.

Mixed powder AC

A powder obtained by similarly milling a mixture of powders of the copolymer used in A above with those of NaOH and $Ca(OH)_2$ in the weight ratio of 80:40:150.

Mixed powder BC

A powder obtained by similarly milling a mixture of powders of the copolymer used in B above with those of NaOH and $Ca(OH)_2$ in the weight ratio of 80:40:150.

Aqueous solutions A-150, A-200 and A-250

Aqueous solutions obtained by respectively adding 150, 200 and 250 parts by weight of water to the mixed powder A per 120 parts of the total weight of the copolymer and NaOH, and blending the resulting mixture with agitation.

Aqueous solutions AC-150, AC-200 and AC-250

Aqueous solutions obtained by respectively adding 150, 200 and 250 parts by weight of water to the mixed powder AC per 120 parts of the total weight of the copolymer and NaOH, and blending the resulting mixture with agitation.

Aqueous solutions B-150, B-200 and B-250

Aqueous solutions obtained by respectively adding 150, 200 and 250 parts by weight of water to the mixed powder B per 120 parts of the total weight of the copolymer and NaOH, and blending the resulting mixture with agitation.

Aqueous solutions BC-150, BC-200 and BC-250

Aqueous solutions obtained by respectively adding 150, 200 and 250 parts by weight of water to the mixed powder BC per 120 parts of the total weight of the copolymer and NaOH, and blending the resulting mixture with agitation.

The viscosity of each of the above 12 aqueous solutions measured by a B-type viscosimeter at 30° C. is shown in Table 1.

TABLE 1

| | Composition | | | | |
|---|---|---|---|---|---|
| Test sample | Amount of isobutylene-maleic anhydride copolymer (g) | NaOH (g) | $Ca(OH)_2$ (g) | Water (g) | Viscosity (CP) at 30° C. |
| A-150 | MW (5.5–6.5 × $10^4$) | 40 | 0 | 150 | 40000 |
| A-200 | 80 | | | 200 | 5000 |
| A-250 | | | | 250 | 1000 |
| AC-150 | | | 150 | 150 | Pasty; not determinable |
| AC-200 | | | | 200 | Pasty; not determinable |
| AC-250 | | | | 250 | 47000 |

TABLE 1-continued

| Composition | | | | | |
|---|---|---|---|---|---|
| Test sample | Amount of isobutylene-maleic anhydride copolymer (g) | NaOH (g) | $Ca(OH)_2$ (g) | Water (g) | Viscosity (CP) at 30° C. |
| B-150 | MW (16-17 × $10^4$) | 40 | 0 | 150 | 80000< |
| B-200 | | | | 200 | " |
| B-250 | 80 | | | 250 | 20000 |
| BC-150 | | | 150 | 150 | Pasty; not determinable |
| BC-200 | | | | 200 | |
| BC-250 | | | | 250 | Pasty; not determinable |

As is shown in Table 1, the samples of AC and BC series, i.e., those containing $Ca(OH)_2$ were pasty and their viscosities were not determinable except AC-250.

Among the samples prepared by adding no $Ca(OH)_2$, those containing a high molecular weight copolymer or a little amount of water had a high viscosity.

It is generally stated that a liquid binder having a viscosity not more than about 2,000 CP (at 20° C.) can be easily used for making a mold. A liquid binder having a viscosity exceeding the above limitation may be also used in practice, but such binder can not be used in such case that refractory particles employed comprise JIS No. 150 or No. 200 fine silica sand, because the binder is not well dispersed throughout the refractory particles and forms a briquette of the binder.

Thus, Table 1 shows that a pasty binder having no flowability because of its high viscosity cannot be used together with fine silica sand.

EXAMPLE 2

As is shown by Item Nos. 1, 2, 3, 7, 8 and 9, mixtures were prepared by adding 27 g of mixed powder AC or BC of Example 1 to 1 kg of JIS No. 65 silica sand. Further, as is shown by Item Nos. 4, 5 and 6, other mixtures were prepared by adding 42 g of AC-150, 47 g of AC-200 and 52 g of AC-250 to 1 kg of silica sand. Similarly, as is shown by Item Nos. 10, 11 and 12, different mixtures were prepared by adding 42 g of BC-150, 47 g of BC-200 and 52 g of BC-250 to 1 kg of silica sand. The above-described mixtures were respectively rammed into test pieces having a diameter of 50 mm and a height of 50 mm. The test pieces were hardened by blowing $CO_2$ gas for 10 seconds at a pressure of 1.5 kg/cm$^2$. The compressive strength and the residual water content of the test piece immediately after $CO_2$ gas blow were determined. Further, the compressive strength and the residual water content of another test piece were similarly determined at the time 24 hours had elapsed after the blowing of $CO_2$ gas. The results are shown in Table 2.

TABLE 2

| Item No. | Test sample | Amount of sample (g) | Amount of water (g) | Immediately after $CO_2$ blow: Compressive strength (kg/cm$^2$) | Immediately after $CO_2$ blow: Residual water content (%) | After 24 Hr: Compressive strength (kg/cm$^2$) | After 24 Hr: Residual water content (%) |
|---|---|---|---|---|---|---|---|
| 1 | AC | 27 | 15 | 4.2 | 1.5 | 12.7 | 0.7 |
| 2 | " | " | 20 | 8.5 | 2.0 | 22.5 | 1.1 |
| 3 | " | " | 25 | 10.7 | 2.5 | 28.0 | 1.4 |
| 4 | AC-150 | 42 | — | * | * | * | * |
| 5 | AC-200 | 47 | — | 0.6 | 1.9 | * | * |
| 6 | AC-250 | 52 | — | 8.7 | 2.5 | 30.5 | 1.1 |
| 7 | BC | 27 | 15 | 3.6 | 1.5 | 10.0 | 0.8 |
| 8 | " | " | 20 | 6.0 | 2.0 | 15.0 | 1.2 |
| 9 | " | " | 25 | 9.0 | 2.5 | 24.5 | 1.5 |
| 10 | BC-150 | 42 | — | * | * | * | * |
| 11 | BC-200 | 47 | — | * | * | * | * |
| 12 | BC-250 | 52 | — | 8.1 | 2.5 | 22.3 | 1.2 |

*Not determined, because the test sample cannot be formed.

The blending proportions of a copolymer, NaOH, $Ca(OH)_2$ and water presented in Table 2 correspond to AC-150, AC-200 and AC-250, and BC-150, BC-200 and BC-250 of Table 1 in composition. Further, the formulation comprising 27 g of AC and 15 g of water has the same composition as AC-150. Similarly, the formulation comprising 27 g of AC and 20 g of water and that comprising 27 g of AC and 25 g of water have the compositions comparable with AC-200 and AC-250, respectively. In short, a difference is only that powders and water are added either separately or as a solution.

The mark * for the data of compressive strength shown in Table 2 means that a test piece was not sucessfully formed, as a binder was not uniformly dispersed.

Table 2 also shows that when a binder is added as a solution, a test piece cannot be formed at a very high concentration of active components, whereas a test piece which exhibits a considerable strength can be obtained by adding the powders and water separately.

A binder cannot be satisfactorily dispersed even if it is intended to blend a copolymer, NaOH, $Ca(OH)_2$, water and silica sand at a blending proportion shown in Table 2, unless binder powders are previously prepared according to this invention.

EXAMPLE 3

Mixed powder DC

A mixed powder obtained similarly to the mixed powder AC except that instead of powders of an isobutylene-maleic anhydride copolymer, powders of an ethylene-maleic anhydride copolymer having a particle size such that 100% pass a JIS standard sieve of 74μ were used.

Mixed powder EC

A mixed powder obtained similarly to the mixed powder AC except that instead of powders of an isobutylene-maleic anhydride copolymer, powders of a methyl vinyl ether-maleic anhydride copolymer having a particle size such that 100% pass a JIS standard sieve of 74μ were used.

The procedure and test described in Example 2 were repeated using mixed powders DC and EC. The results are shown in Table 3.

TABLE 3

| Powder | Amount of water (g) | Immediately after $CO_2$ blow: Compressive strength ($kg/cm^2$) | Immediately after $CO_2$ blow: Residual water content (%) | After 24 Hr: Compressive strength ($kg/cm^2$) | After 24 Hr: Residual water content (%) |
|---|---|---|---|---|---|
| Mixed powder DC | 25 | 3.5 | 2.4 | 18.0 | 1.3 |
| Mixed powder EC | 25 | 3.2 | 2.5 | 16.0 | 1.3 |

EXAMPLE 4

Mixed powder F

A powder obtained by milling a mixture in a porcelain mill for 10 minutes, said mixture comprising powders of an isobutylene-maleic anhydride copolymer (MW $5.5\times10^4$–$6.5\times10^4$) having a particle size such that 100% pass a JIS standard sieve of 74μ and powders of NaOH in the weight ratio of 80:40.

Mixed powder FC

A powder obtained by similarly milling a mixture comprising powders of the above-described copolymer and those of NaOH and $Ca(OH)_2$ in the weight ratio of 80:40:150.

A mixture obtained by adding 12 g of mixed powder F to 1 kg of JIS No. 65 silica sand followed by addition of 25 g of water, and blending the resulting mixture for 2 minutes was rammed into a cylindrical test piece having a diameter of 50 mm and a height of 50 mm. The test piece which was hardened by heating in a radar range for one minute has a compressive strength of 28.0 $kg/cm^2$.

A mixture obtained by adding 12 g of mixed powder F to 1 kg of JIS No. 65 silica sand followed by addition of an aqueous mixture of 15 g of $Ca(OH)_2$ powders and 25 g of water, and blending the resulting mixture for 2 minutes was rammed into test pieces of the above-described size. A test piece which was hardened by blowing $CO_2$ gas at a pressure of 1.5 $kg/cm^2$ for 10 seconds shows a compressive strength of 5.8 $kg/cm^2$ and a residual water content of 2.4%. Another test piece which was allowed to stand in the air for 24 hours after hardened by $CO_2$ gas shows a compressive strength of 20.5 $kg/cm^2$ and a residual water content of 1.5%.

A mixture obtained by adding 12 g of mixed powder F and 15 g of $Ca(OH)_2$ powders to 1 kg of JIS No. 65 silica sand followed by addition of 25 g of water, and blending the resulting mixture for further 2 minutes was tested as described above. A test piece immediately after $CO_2$ blow shows a compressive strength of 7.0 $kg/cm^2$ and a residual water content of 2.3%. A test piece which was allowed to stand in the air for 24 hours after $CO_2$ gas blow shows a compressive strength of 24.0 $kg/cm^2$ and a residual water content of 1.4%.

The procedure and the test described in Example 2 were repeated using mixed power FC. A test piece immediately after $CO_2$ gas blow has a compressive strength of 10.0 $kg/cm^2$ and a residual water content of 2.5%, whereas a test piece which was allowed to stand in the air for 24 hours after $CO_2$ gas blow has a compressive strength of 28.0 $kg/cm^2$ and a residual water content of 1.3%. The compressive strength of a test piece which was hardened by heating in a radar range for 1 minute immediately after the formation thereof is 26.0 $kg/cm^2$.

EXAMPLE 5

A mixture is obtained by adding 27 g of mixed powder FC to 1 kg of JIS No. 65 silica sand followed by addition of 25 g of water, blending the resulting mixture for one minute, adding an additive shown in Table 4 in the indicated amount, and blending the resulting mixture for further one minute. The mixture thus obtained is rammed into test pieces as described in the preceding examples. The compressive strength and the residual water content of a test piece immediately after hardened by $CO_2$ gas and a test piece which was allowed to stand in the air for 24 hours after hardened by $CO_2$ gas, as well as the compressive strength of a test piece which was hardened by heating in a radar range for 1 minute immediately after the formation thereof are shown in Table 4.

TABLE 4

| Powder | Amount of powder (g) | Amount of water (g) | Sort of additive and amount thereof (g) | Immediately after $CO_2$ blow: Compressive strength ($kg/cm^2$) | Immediately after $CO_2$ blow: Residual water content (%) | After 24 Hr: Compressive strength ($kg/cm^2$) | After 24 Hr: Residual water content (%) | Compressive strength: radar range 1 min. ($kg/cm^2$) |
|---|---|---|---|---|---|---|---|---|
| Mixed powder FC | 27 | 25 | methanol 2 | 12.5 | 2.4 | 27.0 | 1.1 | — |
| " | " | " | latex 8 | 13.0 | 2.8 | 36.5 | 1.5 | 41.0 |
| " | " | " | glycerol 3 | 13.5 | 2.4 | 27.5 | 1.2 | — |
| " | " | " | ethylene glycol 3 | 14.2 | 2.5 | 28.1 | 1.2 | — |
| " | " | " | sorbitol 5 | 15.0 | 2.6 | 28.5 | 1.3 | 29.0 |
| " | " | " | sodium polyacrylate 5 | 13.5 | 2.8 | 37.2 | 1.4 | 40.0 |

EXAMPLE 6

60 g of a hydrophobic resol-type phenol resin (SP456®) having a particle size such that 80% pass a JIS (A.S.T.M.) standard sieve of 44μ, 60 g of an isobutylene-maleic anhydride copolymer (MW $5.5$–$6.5\times10^4$) having a particle size such that 100% pass a JIS standard sieve of 74μ, 60 g of NaOH powders and 150 g of $Ca(OH)_2$ powders were milled in a porcelain ball mill for 10 minutes. 33 g of the resulting mixed powders were added to 1 kg of JIS No. 65 silica sand followed by addition of 28 g of water, and the mixture was blended for 5 minutes to obtain a molding composition. The thus obtained composition was rammed into test pieces similarly to the preceding examples and subjected to the same test. A test piece immediately after $CO_2$ gas blow shows a compressive strength of 4.8 $kg/cm^2$ and a residual water content of 2.4%. A test piece allowed to stand for 24 hours after $CO_2$ gas blow shows a compressive strength of 19.5 kg/cm$^2$ and a residual water content of 1.3%.

EXAMPLE 7

Powders of an isobutylene-maleic anhydride (MW $5.5\times10^4$–$6.5\times10^4$) having a particle size such that 15% pass a JIS standard sieve of 74μ and those of NaOH and $Ca(OH)_2$ in the weight ratio of 80:40:150 were mixed and agitated together with water. The resulting mudlike product was dehydrated and solidified, as the temperature of the system was elevated to 120° C. or more by exothermic reaction. The product obtained was further dried at 100° C. for 2 hours. The dried product was ground in a ball mill made of iron to collect Item No. 1 powder of 210μ minus-mesh and 74μ plus-mesh; Item No. 2 powder of 74μ minus-mesh and 44μ plus-mesh; and Item No. 3 powder of 44μ minus-mesh measured by the JIS (or A.S.T.M.) standard sieve series. The procedure and the test described in Example 2 were repeated using these binder powders. The results are shown in Table 5.

TABLE 5

| Item No. | Powder | Amount of powder (g) | Amount of water (g) | Immediately after $CO_2$ blow: Compressive strength (kg/cm$^2$) | Immediately after $CO_2$ blow: Residual water content (%) | After 24 Hr: Compressive strength (kg/cm$^2$) | After 24 Hr: Residual water content (%) |
|---|---|---|---|---|---|---|---|
| 1 | 210μ minus-mesh 74μ plus-mesh | 27 | 25 | 7.0 | 2.5 | 18.0 | 1.0 |
| 2 | 74μ minus-mesh 44μ plus-mesh | " | " | 9.0 | 2.4 | 24.5 | 1.1 |
| 3 | 44μ minus-mesh | " | " | 10.0 | 2.5 | 25.0 | 1.2 |

EXAMPLE 8

A powder binder having the same composition as that of the mixed powder FC was prepared in a large amount. 540 g of the resulting powder and 500 g of water were added to 20 kg of JIS No. 100 silica sand. The mixture obtained was blended in a whirl mixer for 2 minutes to obtain a molding composition.

The molding composition was filled within a wooden pattern having a diameter of 200 mm and a height of 400 mm. The composition was then hardened by blowing $CO_2$ gas downwardly from the upper portion at a pressure of 2.5 kg/cm$^2$ for 40 seconds. The operating conditions and the state of the inner part of the hardened composition immediately after $CO_2$ gas blow (the hardened product was cut into two pieces at the center line to observe the inner part thereof) were examined.

For comparative purpose, another molding composition was prepared in such manner that instead of 540 g of the powdered binder and 500 g of water, a liquid binder obtained by previously dissolving the same powder in 600 g of water was employed. This composition was similarly tested. The results are shown in Table 6.

TABLE 6

| Binder | Operating conditions of mold-making | State of inner part after hardening |
|---|---|---|
| Powder | No parting material is necessary | Hardening |

TABLE 6-continued

| Binder | Operating conditions of mold-making | State of inner part after hardening |
|---|---|---|
| | to withdraw a hardened product from a wooden pattern, as the product is not adhesive to the pattern. | speed is high, and the inner part was uniformly hardened. |
| Liquid | A parting material is required to withdraw a hardened product from a wooden pattern, as the product is adhesive to the pattern. | Hardening speed decreases to some extent, and defects of hardening occurred in the inner part. |

Further, casing cores of about 2 kg and about 50 kg were formed from the molding composition of this example. These cores were hardened by blowing $CO_2$ gas therethrough. The hardened cores were attached to molds, and cast iron pump casings having a molding weight of about 15 kg and that of about 180 kg were cast. There were obtained sound castings free from a casting defect. In particular, the cores obtained by using a binder material according to this invention was easily disintegrated and the shake-out operation was straightforward.

EXAMPLE 9

80 Grams of powders of an isobutylene-maleic anhydride copolymer (M.W. $5.5\times10^4$–$6.5\times10^4$) having a particle size such that 100 % pass through a JIS (or A.S.T.M.) standard sieve of 74μ, 40 g of KOH powders and 150 g of $Ca(OH)_2$ powders were subjected to milling for 10 minutes in a porcelain ball mill to produce powder GC.

80 Grams of powders of an isobutylene-maleic anhydride copolymer (M.W. $5.5\times10^4$–$6.5\times10^4$) having a particle size such that 100 % pass through a JIS standard sieve of 74μ, 40 g of LiOH powders and 150 g of $Ca(OH)_2$ powders were subjected to milling for 10 minutes in a porcelain ball mill to give powder HC.

Powders of an isobutylene-maleic anhydride copolymer (M.W. $5.5\times10^4$–$6.5\times10^4$) having a particle size such that 15% pass through a JIS standard sieve of 74μ, KOH powders, $Ca(OH)_2$ powders and water were mixed and agitated in a weight ratio of 80:40:150:50. The resulting mud-like product was dehydrated and solidified, as the temperature of the system was elevated to 120° C. or more by remarkable exothermic reaction. The resultant product was dried for 2 hours at 100° C. and then was ground in a ball mill made of iron to provide powder IC having a particle size such that all pass through a JIS standard sieve of 210μ and 80% do not pass through a 74μ sieve.

To 1 kg of JIS No. 65 silica sand, 27 g of powder GC, HC or IC were added and mixed and furthermore 25 g of water were added and mixed for 2 minutes to produce the corresponding mixture. The mixture was rammed into a test piece having a diameter of 50 mm and a height of 50 mm. The test piece was hardened by blowing $CO_2$ gas for 10 seconds at a pressure of 1.5 kg/cm$^2$. The compressive strength and residual water content of the test piece immediately after the blowing of $CO_2$ gas were determined. Similarly, the compressive strength and residual water content of another test piece when it was left in the atmosphere for 24 hours after the blowing of $CO_2$ gas were determined.

In the case of powder GC, the compressive strength of the test piece immediately after the blowing of $CO_2$ gas was 7.5 kg/cm$^2$ and the residual water content was 2.5 %, and the compressive strength when 24 hours had elapsed after the blowing of $CO_2$ gas was 25.5 kg/cm$^2$ and the residual water content was 1.4%.

In the case of powder HC, the compressive strength of the test piece immediately after the blowing of $CO_2$ gas was 5.2 kg/cm$^2$ and the residual water content was 2.4%, and the compressive strength of the test piece when 24 hours had elapsed after the blowing of $CO_2$ gas was 22.5 kg/cm$^2$ and the residual water content was 1.5%.

In the case of powder IC, the compressive strength of the test piece immediately after the blowing of $CO_2$ gas was 8.7 kg/cm$^2$ and the residual water content was 2.4%, and the compressive strength of the test piece when 24 hours had elapsed after the blowing of $CO_2$ gas was 27.3 kg/cm$^2$ and the residual water content was 1.4%.

What is claimed is:

1. A powdered binder which comprises an intimate mixture of a copolymer of maleic anhydride with an olefinically unsaturated compound selected from the group consisting of an aliphatic $\alpha$-olefin having 2 to 8 carbon atoms, styrene and methyl vinyl ether, 0.2 to 2.0 equivalents of a caustic alkali per carboxyl equivalent of said copolymer and 0.3 to 5.0 parts by weight of an alkaline earth metal hydroxide per 1 part of the total weight of said copolymer and said caustic alkali.

2. The powdered binder of claim 1 wherein said alphatic $\alpha$-olefin is ethylene or isobutylene.

3. The powdered binder of claim 1 wherein said copolymer has a molecular weight of $17\times10^4$ or less.

4. The powdered binder of claim 1 wherein said austic alkali is NaOH or KOH.

5. The powdered binder of claim 1 wherein said alkaline earth metal hydroxide is $Ca(OH)_2$.

6. The powdered binder of claim 1 wherein 0.8 to 2.0 parts by weight of said alkaline earth metal hydroxide is intimately mixed with 1 part of the total weight of said copolymer and said caustic alkali.

7. A process for preparing a mold which comprises mixing refractory particles with a powdered binder, alkaline earth metal hydroxide powders and water, and forming the resulting mold-making composition into a shaped product, whereafter the shaped product is hardened by blowing $CO_2$ gas therethrough, said powdered binder comprising an intimate mixture of a copolymer of maleic anhydride with an olefinically unsaturated compound selected from the group consisting of an aliphatic $\alpha$-olefin having 2 to 8 carbon atoms, styrene and methyl vinyl ether, and 0.2 to 2.0 equivalents of a caustic alkali per carboxyl equivalent of said copolymer.

8. The process of claim 7 wherein said aliphatic $\alpha$-olefin is ethylene or isobutylene.

9. The process of claim 7 wherein said copolymer has a molecular weight of $17\times10^4$ or less.

10. The process of claim 7 wherein said caustic alkali is NaOH or KOH.

11. The process of claim 7 wherein said alkaline earth metal hydroxide is $Ca(OH)_2$.

12. A process for preparing a mold which comprises mixing refractory particles with a powdered binder and water, and forming the resulting mold-making composition into a shaped product, whereafter the shaped product is hardened by blowing $CO_2$ gas therethrough, said powdered binder comprising an intimate mixture of a copolymer of maleic anhydride with an olefinically unsaturated compound selected from the group consisting of an aliphatic $\alpha$-olefin having 2 to 8 carbon atoms, styrene and methyl vinyl ether, 0.2 to 2.0 equivalents of a caustic alkali per carboxyl equivalent of said copolymer, and 0.3 to 5.0 parts by weight of an alkaline earth metal hydroxide per 1 part of the total weight of said copolymer and said caustic alkali.

13. The process of claim 12 wherein said aliphatic $\alpha$-olefin is ethylene or isobutylene.

14. The process of claim 12 said copolymer has a molecular weight of $17\times10^4$ or less.

15. The process of claim 12 wherein said caustic alkali is NaOH or KOH.

16. The process of claim 12 wherein said alkaline earth metal hydroxide is $Ca(OH)_2$.

17. The process of claim 12 wherein the powdered binder to be used comprises an intimate mixture of 0.8 to 2.0 parts by weight of said alkaline earth metal hydroxide with 1 part of the total weight of said copolymer and said caustic alkali.

* * * * *